United States Patent [19]

Estes, Jr. et al.

[11] 3,989,788

[45] Nov. 2, 1976

[54] METHOD OF MAKING A BONDED NON-WOVEN WEB

[75] Inventors: Leland Lloyd Estes, Jr., Goodlettsville; Anton Fridrich Fridrichsen, Nashville; Victor Simeon Koshkin, Hendersonville, all of Tenn.

[73] Assignee: E. I. Du Pont de Nemours and Company, Wilmington, Del.

[22] Filed: Apr. 25, 1973

[21] Appl. No.: 354,506

[52] U.S. Cl. ..... 264/120; 156/62.2; 264/122; 264/123; 264/126; 264/345; 264/346

[51] Int. Cl.[2] ..... D04H 1/54; B29F 5/00

[58] Field of Search ..... 264/123, 109, 122, 126, 264/345, 346, 125, 120; 161/150, 157, 170; 156/62.2, 62.4

[56] References Cited

UNITED STATES PATENTS

| | | | |
|---|---|---|---|
| 2,476,282 | 7/1949 | Castellan | 161/150 |
| 2,543,101 | 2/1951 | Francis | 161/150 |
| 2,931,068 | 4/1960 | Kitson et al. | 264/342 RE |
| 2,952,879 | 9/1960 | Kitson et al. | 264/342 RE |
| 3,030,173 | 4/1962 | Kurzke et al. | 264/342 RE |
| 3,313,665 | 4/1967 | Berger | 161/150 |
| 3,377,220 | 4/1968 | Berger et al. | 264/122 |
| 3,423,501 | 1/1969 | Dennis et al. | 264/345 |
| 3,449,486 | 6/1969 | Contractor | 264/123 |
| 3,494,819 | 2/1970 | McAlister | 161/150 |
| 3,549,597 | 12/1970 | Kitson et al. | 264/345 |

OTHER PUBLICATIONS

Mandelkern, Crystallization of Polymers, McGraw–Hill, N.Y. (1965), p. 3, 1967, 1968 and 321–326 Relied on.

*Primary Examiner*—Willard E. Hoag

[57] ABSTRACT

Process for continuous bonding of a fibrous nonwoven web of polyethylene terephthalate matrix and copolyester binder filaments which comprises depositing the matrix and binder filaments as a nonwoven web on a moving belt, steam treating the nonwoven web under restraint thereby consolidating the web, removing the restraint, transferring the consolidated web from the moving belt to a bonder, and finally bonding the web with a flow of hot air through the web.

4 Claims, 3 Drawing Figures

FIG. 1
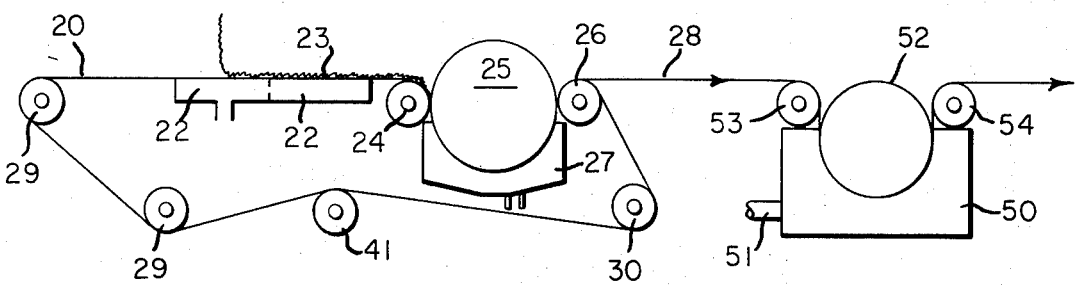
FIG. 2
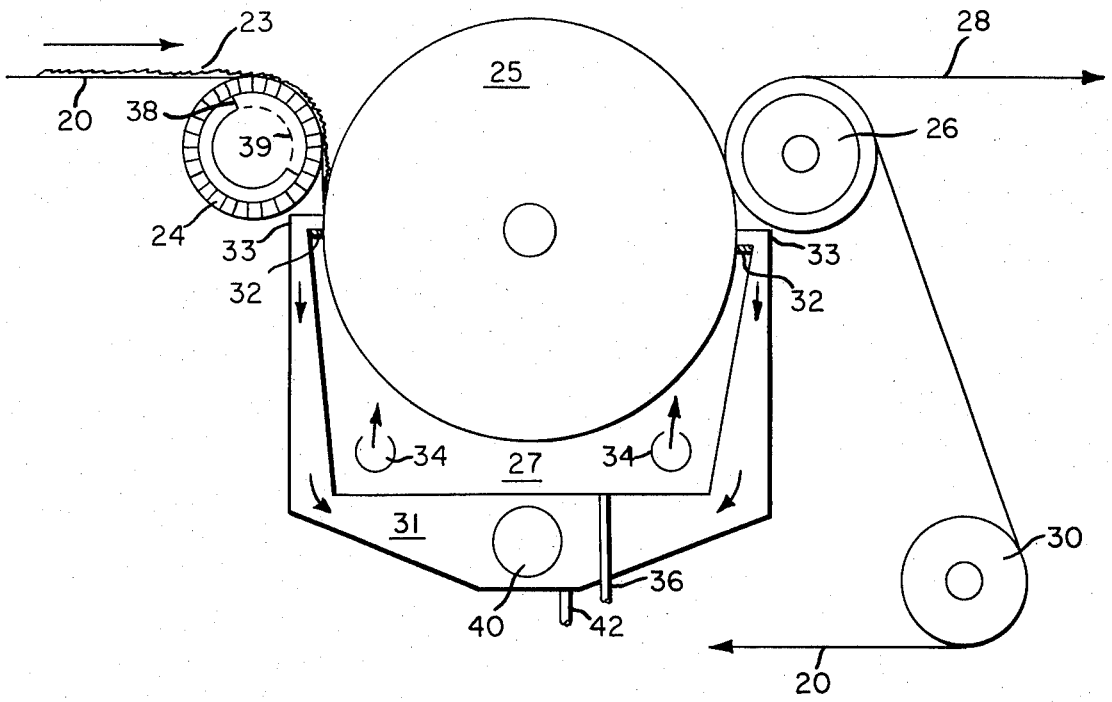
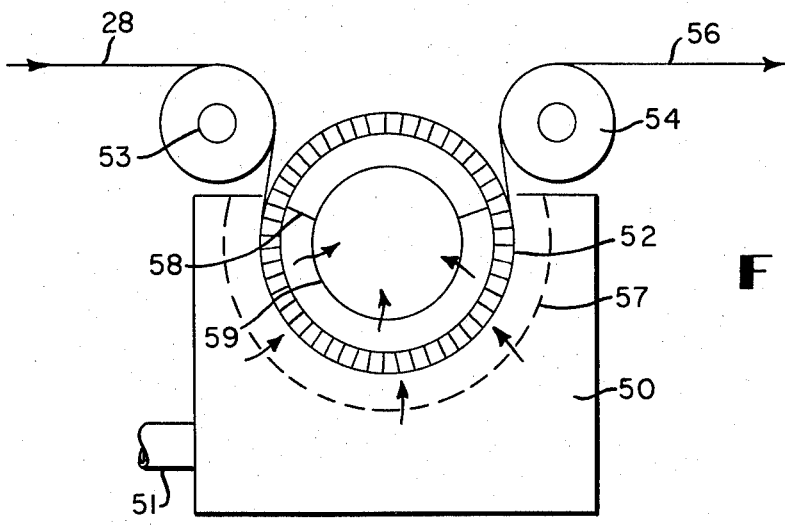
FIG. 3

METHOD OF MAKING A BONDED NON-WOVEN WEB

BACKGROUND OF THE INVENTION

It is known from Kinney, U.S. Pat. No. 3,338,992 to prepare loose fibrous webs by depositing well separated filaments upon a moving collecting surface in random array. Processes are also known for heat treating such webs to prepare bonded nonwoven sheets. When the webs are composed of polyester filaments, changes in the crystalline structure of the polymeric material occur, such changes in crystallinity being taught in Piccard et al. U.S. Pat. No. 2,836,576.

One known method of bonding is to expose the web to high pressure steam while the web is restrained by compressive forces applied by belts, screens or other devices. A process of this type is described in Levy, U.S. Pat. No. 3,276,944. The present process relates to bonding of mixtures of homopolymer filaments and copolymer filaments.

Another known method for bonding fibrous webs is to blow hot air through the web as in Krikorian, U.S. Pat. No. 3,417,925 or by use of flow-through paper drying machinery. By the latter method, nonwoven sheets have been prepared using a vacuum roll with a pervious honeycomb surface as described by E. T. Bryand in Paper Trade Journal, Mar. 15, 1971. The roll surface provides support for the fibrous web during bonding. Hot air is directed against the filamentary web to heat it and the air is pulled through the web by means of a vacuum applied from the inside of the pervious roll surface which also serves to hold the web against the roll.

The present process is particularly useful for bonding mixtures of polyethylene terephthalate homopolymer and copolymer filaments. It permits high speed consolidation of the web on the collection belt, transfer of the consolidated web, i.e., one which can support its own weight, to the bonder and bonding the web at reduced temperatures.

SUMMARY OF THE INVENTION

The invention provides an efficient process for preparing a bonded nonwoven sheet which comprises depositing on a moving belt, a nonwoven filamentary web of a mixture of from about 70 to 95% by weight of polyethylene terephthalate matrix filaments and from about 5–30% by weight of copolyester binder filaments wherein about 70 to 90% by weight of the copolymer comprises ethylene terephthalate repeating units, the matrix filaments having a crystallinity index between 8 and 25%, continuously passing the web under compressional restraint of from about 0.2 to 2.0 lbs./in.$^2$ through an atmosphere of saturated steam, the exposure time being at least 0.1 sec. but less than 1 minute, preferably 0.2 to 6 seconds whereby the molecular orientation (as measured by birefringence) of the binder fiber is reduced and its melt-stick temperature is lowered, removing the compressional restraint, transferring the consolidated web from the moving belt to a bonding zone, and finally bonding the web in the bonding zone with a flow of hot air through the web at a velocity of from about 250 to 800 ft./min., the temperature of the hot air being from about 140° to 250° C. and the exposure time being from 0.1 sec. to 1 min., preferably from 0.2 sec. to 6 sec. whereby the binder filaments melt.

LIST OF FIGURES

FIG. 1 is a schematic diagram showing apparatus for performing the process of the invention.

FIG. 2 is a schematic elevational view showing details of the steam consolidation equipment.

FIG. 3 is a schematic elevational view showing the hot air bonding device.

DETAILS OF THE INVENTION

Referring to FIG. 1, the process of the invention encompasses use of a collecting zone, consolidating zone and bonding zone.

The process of the invention is applied to a loose nonwoven web of polyester filaments. The web contains both homopolymer filaments of polyethylene terephthalate, and copolymer filaments of 70 to 90% by weight ethylene terephthalate repeating units and 10 to 30% by weight of other ester repeating units. The homopolymer fiber constitutes the matrix fiber while the copolymer filaments have a lower melting point and are referred to as the binder filaments. The percentages by weight of binder filaments is between about 5 and 30, the remainder being matrix filaments. The copolyester binder filaments are preferably polyethylene terephthalate/isophthalate filaments. The weight of the webs to be treated in accordance with this process will generally be from 0.3 to 6 oz./yd.$^2$.

The process of the invention involves steam consolidation of the aforementioned loose, as-deposited web followed by hot air bonding of the consolidated web. For the consolidation step, saturated steam at essentially atmospheric pressure is used. The web may be heated additionally if desired by the hard roll over which it passes. The pressure which is applied in this step between the collecting belt and the hard roll is about 0.2 to 2.0 lbs./in.$^2$. This pressure is calculated from belt tension and the diameter of the hard roll. As the web leaves the consolidation area it passes through a nip which may exert a mean pressure as high as 200 lbs./in.$^2$. Low or no nip pressure is applied to lightweight webs while high nip pressure is used to increase compaction and to improve bonding through the entire thickness of heavy weight webs. Residence time in the steam consolidator, i.e., time that the web is exposed to the steam, is between 0.1 sec. and 1 min. with 0.2 sec. to 6 sec. preferred.

The consolidated web leaving the steam consolidation zone is then free from compressional restraint. At this point it needs no support for travel to the hot air bonder, the consolidation having rendered the web self-supporting. The web is then transferred to the hot air bonder.

The temperatures used in the bonding operation are considerably higher than those used in consolidation, the temperature selected being dependent upon the properties desired in the product (i.e., strength, dimensional stability or stiffness). Typically the consolidated web is exposed to air at 140° to 250° C. preferably 215° to 250° C. during bonding while the web temperature is in the range of 135° to 225° C. Web restraint in the hot air bonder is provided by air flowing through the web and porous drum. One employs an air velocity that is sufficient to provide adequate heat input for bonding under the required restraint. Normally, 250–800 feet/minute is sufficient. Residence time in the hot air bonder, i.e., time that the consolidated web is exposed to the hot air, is between 0.1 sec. and 1 minute with 0.2 sec. to 6 sec. preferred.

In the web formation zone, filaments are deposited on a collecting belt in random orientation or in programmed orientation to provide a loose filamentary web. This loose web does not have sufficient cohesion to support itself if lifted from the collecting belt.

The steam consolidation zone provides the web with sufficient strength for unsupported transfer. This is accomplished by heating the matrix filaments and binder filaments quickly in the presence of steam while under compressional restraint. The compressional forces are provided by the tension of the collecting belt against the steam consolidation roll. In this step of the process the binder filaments become tacky, generating some binder-to-binder bonds and binder-to-matrix bonds. The matrix and binder filaments also become mechanically interlocated and additional compaction may occur under the influence of the exit nip roll.

In the consolidation zone, the binder filaments undergo some deorientation thereby lowering the temperature range over which they will stick to other filaments. The matrix filaments are not appreciably affected by the consolidation step.

In the process of this invention steam is required in the consolidation step because of its efficiency in lowering the melt-stick temperature of the binder filaments. It has been found, for example, that in the steam consolidation step the melt-stick temperature of bonder filaments has been lowered from 215° C. to about 188° C.

The hot air bonding that takes place following steam consolidation provides the necessary sheet properties such as tear strength and tensile strength. In the hot air zone the matrix and binder fibers bond to one another. The binder fibers soften, melt, or flow. The matrix fibers soften only slightly. In this operation the matrix fibers are crystallized and heat set in the desired configuration. The binder fibers lose much of their filamentary form and act as an adhesive.

The hot air used in the bonder flows under the influence of a vacuum pulling from within the process bonding roll, through the sheet. The air flow exerts a pressure on the sheet and there is a pressure drop, generally of from about 0.8 in. to 6 in. water, through the sheet depending on sheet basis weight and other factors.

Considering FIG. 1 in more detail, homopolymer (matrix) filaments and copolymer (binder) filaments are deposited on a collecting belt 20 as a loose filamentary web 23. The filaments may be deposited, for example, as described in Medeiros et al. U.S. Pat. No. 3,384,944, particularly FIG. 1. In one process described in Medeiros et al. the matrix and binder filaments are extruded as separate streams, organized into ribbons of parallel filaments, electrostatically charged to promote separation between the filaments and the ribbons combined and drawn forward by rolls. The filaments are then stripped from the rolls by a jet device which forwards and directs the filaments to a collecting surface, such as collecting belt 20 of instant FIG. 1. Collecting belt 20 is porous, such as a screen belt. Vacuum is applied underneath the porous belt through vacuum boxes 22 to draw the filaments towards the belt. Water sprays may also be used to hold fibers to the collecting belt.

The loose filamentary web 23 passes along with the belt into the consolidation zone first by passing over the porous suction roll 24 which keeps the filaments against the belt by force of air which is pulled through the filament layer 23, belt 20 and into roll 24 by suction means not shown. The web is then passed around the lower side of a heated hard impervious consolidator roll 25, while restrained between the collecting belt and roll 25. The consolidated web then passes over exit nip roll 26 and separates from the collecting belt as it leaves exit nip and belt drive roll 26. The consolidated web 28 is then passed to the bonding zone. The collecting belt after separation from the consolidated web passes around belt tension roll 30, tracking roll 41 and idler rolls 29 and returns to the collecting zone.

The consolidated web 28 is now able to support itself. It passes under light tension to the bonding zone. Here it is further heated but this time without application of mechanical pressure. A blast of hot air is provided from air chamber 50 supplied by duct 51 and this is directed from chamber 50 to press the web against porous bonder roll 52. Bonder feed roll 53 and exit roll 54 provide little or no pressure and act as web guides. Air is removed through porous bonder roll 52 by means of a suction exhaust tube. The bonded sheet 56 then passes to a windup device (not shown).

Considering the consolidation process in more detail, in FIG. 2, the loose filamentary web 23 on belt 20 leaving porous suction roll 24 is then restrained between the belt and the heated consolidator, hard roll 25. Saturated steam is supplied to the steam chamber 27 through steam nozzles 34. The nozzles are located along the length of a pipe which is at least as long as the web width. The steam permeates the web and promotes consolidation of the web, this being further aided by pressure exerted between collecting belt 20 and the hard consolidator roll 25. This pressure which is termed compressional restraint is applied by applying tension to the belt by means of tension roll 30. Additional pressure may, if desired, be applied between the exit nip roll 26 and hard roll 25 by forcing the nip roll against the hard roll by means of air cylinders working on the pivotted axle supports (not shown).

The web is heated while constrained between the belt and hard roll. The hard roll 25 may be internally heated if desired. A positive pressure is maintained in the steam chamber 27 by chamber seals 32 and air is excluded so far as possible. Escaping steam and entrained air are removed through the steam exhaust chamber 31 which leads to exhaust duct 40. Any condensed steam from the steam exhaust chamber is removed through a trapped outlet 42. Similarly condensed steam from steam chamber 27 is removed through trapped outlet 36. The partially consolidated web is further compacted while still hot (>80° C.) between the collecting belt 20 and the consolidator roll 25 using pressure exerted by the exit nip roll 26. The exit nip roll may be elastomer covered to uniformize nip pressures. High exit nip pressures are used when a high degree of compaction is desired but adequately consolidated webs may also be made without exit nip loading if bulky products are desired.

Considering FIG. 3, consolidated web 28 enters the bonder by passing over the inlet roll 53 onto the porous rotating bonder roll 52 having a honeycomb surface covered with a fine screen to provide additional support. Hot air entering the air chamber 50 through the hot air supply duct 51 flows through the distribution plate 57 and is sucked through the web and the porous bonder roll into the stationary suction exhaust tube 59 over the arc circumscribed by the stationary bonded roll baffles 58. Supply and exhaust air flows are balanced so there is little tendency for air flow into or out of the bonder.

Bonded web 56 passes over exit roll 54 to a windup device (not shown).

TEST METHODS

The test methods used in the examples are performed either on single filaments removed from the web or on the web itself. Tests which employ single filaments are birefringence, crystallinity index, melt-stick temperature, tenacity and elongation. These tests are run on filaments (1) as deposited on the collecting belt, (2) as removed from the consolidated sheet or (3) as removed from the bonded sheet. Care should be used in removing filaments from the web.

Birefringence is determined on collected fibers or steam consolidated fibers by the method indicated in Levy U.S. Pat. No. 3,276,944, Cols. 9 and 10, measuring at locations which are free of bond sites. Round filaments are measured according to Col. 9, line 44 to Col. 10, line 22. Nonround are measured according to Col. 10, lines 43 to 52.

Crystallinity Index is the percent crystallinity as determined by density measurements. The density, d, of the matrix filaments after removal from the sheet is determined by the density gradient method using a density gradient tube with carbon tetrachloride in the lower end of the tube and heptane in the top end. The tube is calibrated by use of insoluble materials with known density. The crystallinity index is calculated by comparing the density, d, with density values for amorphous polymer and polymer having the maximum crystallinity level achievable. These two reference materials are described in Kitson & Reese U.S. Pat. No. 2,952,879, Col. 3. The density of the amorphous material, $d_a$, and the density of maximum crystallinity, $d_{mc}$, are used in the following equation to determine crystallinity index, C.I.:

$$C.I. = \frac{d - d_a}{d_{mc} - d_a} \times 100$$

Melt-Stick Temperature is determined by use of a heated gradient bar using crystalline materials of known melting point to calibrate the bar.

Tenacity and Elongation are determined with single filaments using an Instron Tensile Tester (constant elongation rate). Tenacity is the breaking strength in grams per denier. Elongation is the percent elongation at break based on original length.

Tongue Tear and Strip Tensile are properties of the bonded sheet and are determined by the methods described in Levy U.S. Pat. No. 3,276,944, Col. 9.

Relative Viscosity, RV, is determined at 25° C. in a solution containing 4.75% by weight of polymer, using hexafluoroisopropanol as solvent and using other known procedures.

EXAMPLES I AND II

Filaments spun from polyethylene terephthalate homopolymer (HO) (RV=26) and copolymer filaments (CO) spun from a copolymer (RV=24) containing about 80% repeating units of polyethylene terephthalate and about 20% repeating units polyethylene isophthalate were drawn and deposited on a porous, moving collecting belt as shown in FIG. 1 and passed from the collecting zone into the steam consolidation zone. The consolidation conditions are shown in Table 1. The consolidated web was next passed into a hot air bonder and treated under the conditions shown in Table 1.

It will be noted in Table 1 that the crystallinity index of the matrix filaments increased and very little deorientation occurred during the consolidation step. The binder filaments, however, did not change much in crystallinity index but deoriented considerably as shown by birefringence measurements. In the next step, bonding, the binder becomes sticky or melts while the matrix becomes more crystalline.

EXAMPLE III

A web of filaments having the same homopolymer composition and copolymer composition as in Examples I and II was prepared. In this case, however, the homopolymer filaments after drawing had a denier per filament of 4.0 and the copolymer amounted to 12% by weight. The collected sheet was passed through a steam consolidator as in Example II. The consolidator steam temperature was 100° C., residence time 0.28 second and exit nip pressure 50 psi. This product was exposed at various conditions in the hot air bonder shown in FIG. 3. The various processing conditions are shown in Table 2. It will be noted that as bonding temperature is increased fiber strength and fiber elongation decreases. Likewise, tongue tear strength decreases with increases in temperature. The losses in fiber strength at high temperature may be overcome by shortening the residence time in the bonder. The faster treatment at high temperature is much preferred since it gives optimum properties at lowest cost.

EXAMPLE IV

A web of filaments was made as in Example II except that lower belt speeds (14 vs. 39 ypm.) and higher compaction in the consolidator were used (150 vs. 50 psi. nip pressure). Lower speeds produced heavier weight webs. Higher compaction reduced bulk (thickness per unit weight) and improved internal bond strength resulting in much stronger webs per unit weight. Process conditions and bonded web properties are shown in Table 3.

TABLE 1

PROCESS CONDITIONS FOR EXAMPLES I AND II

| | Example I | | Example II | |
|---|---|---|---|---|
| Polymer Type | HO | CO | HO | CO |
| Drawn Filament Properties | | | | |
| No. of Filaments | 400 | 68 | 406 | 68 |
| Crystallinity Index, % | 14 | 6 | 14 | 6 |
| Birefringence | 0.040 | 0.026 | 0.04 | 0.023 |
| Melt-Stick Temperature, ° C. | 250 | 215 | — | — |
| DPF | 2.0 | 3.8 | 4.5 | 3.8 |
| % by Weight | 78 | 22 | 88 | 12 |

TABLE 1-continued

PROCESS CONDITIONS FOR EXAMPLES I AND II

| | Example I | | Example II | |
|---|---|---|---|---|
| Polymer Type | HO | CO | HO | CO |
| Cross-Section | Round | Y | Y | Y |
| Consolidation | | | | |
| Belt Speed, ypm. | 33 | | 39 | |
| Web Unit Weight, oz./yd.$^2$ | 0.4 | | 0.8 | |
| Temperature, ° C. (of saturated steam) | 100 | | 100 | |
| Residence Time, sec. | 0.34 | | 0.28 | |
| Exit Nip Pressure, lbs./in.$^2$ | 40 | | 50 | |
| Compressional Restraint, lbs./in.$^2$ | 0.8 | | 0.8 | |
| Consolidated Filament Properties | | | | |
| Crystallinity Index, % | 26 | 8 | 26 | 8 |
| Birefringence | 0.040 | 0.002 | 0.040 | 0.003 |
| Melt-Stick Temperature, ° C. | 253 | 188 | — | — |
| Bonding | | | | |
| Temperature, ° C. | 166 | | 238 | |
| Residence Time, sec. | 1.4 | | 0.6 | |
| Air Velocity, fpm. | 500 | | 500 | |
| Bonded Filament Properties | | | | |
| Crystallinity Index, % | 33 | | 52 | Melted |
| Birefringence | 0.100 | — | 0.120 | — |
| Melt-Stick Temperature, ° C. | 255 | — | 265 | — |
| Bonded Web Properties | | | | |
| Thickness, mils | 3.6 | | 8.3 | |
| Strip Tensile, lbs./in. | 0.8 | | 4.0 | |
| Tongue Tear, lb. | 1.2 | | 1.3 | |

TABLE 2

EFFECT OF BONDING CONDITIONS ON FIBER PROPERTIES AND WEB STRENGTH (EXAMPLE III)

| Item No. | Temp. of Air ° C. | Residence Time Sec. | Fiber Tenacity, gpd. | Fiber Elong., % | Tongue Tear, lbs. |
|---|---|---|---|---|---|
| 1 | 220 | 1.2 | 2.7 | 213 | 2.4 |
| 2 | 230 | 1.2 | 2.3 | 184 | 1.7 |
| 3 | 240 | 1.2 | 2.1 | 115 | 1.4 |
| 4 | 240 | 0.8 | 2.2 | 101 | 1.4 |
| 5 | 240 | 0.2 | 2.5 | 85 | 1.8 |
| 6 | 240 | 0.14 | 3.0 | 104 | 2.0 |

TABLE 3

PROCESS CONDITIONS FOR EXAMPLE IV

| | Example IV | |
|---|---|---|
| Polymer Type | HO | CO |
| Laydown | | |
| No. of filaments | 406 | 68 |
| Cross-section | Y | Y |
| DPF | 4.2 | 3.6 |
| % by Weight | 88 | 12 |
| Belt speed, ypm. | 14 | |
| Web unit weight, oz./yd.$^2$ | 3.0 | |
| Consolidation | | |
| Temp., ° C. | 100 | |
| Residence Time, sec. | 0.77 | |
| Exit Nip Pressure, lbs./in.$^2$ | 150 | |
| Compressional Restraint, lbs./in.$^2$ | 0.8 | |
| Bonding | | |
| Temp., ° C. | 237 | |
| Residence Time, sec. | 3.0 | |
| Air Velocity, fpm. | 500 | |
| Bonded Web Properties | | |
| Thickness, mils. | 17.0 | |
| Strip Tensile, lbs./in. | 25.0 | |

What is claimed is:

1. In a process for preparing a bonded nonwoven sheet wherein there is deposited on a moving belt a non-woven loose filamentary web of a mixture of about 70–95% by weight of polyethylene terephthalate matrix filaments and about 5–30% by weight of copolyester binder filaments, about 70–90% by weight of said copolyester comprising ethylene terephthalate repeating units and 10–30% by weight of the copolyester comprising ethylene isophthalate repeating units, the matrix filaments having a crystallinity index between 8 and 25%, the improvement comprising passing the deposited loose filamentary web under compressional restraint of about 0.2–2.0 lbs./in.$^2$ through saturated steam at practically atmospheric pressure for an exposure time of from 0.2 to 6 seconds to consolidate the web, removing the compressional restraint and forwarding the consolidated web to a bonding zone and finally heating the consolidated web in the bonding zone for an exposure time of from 0.2 to 6 seconds while the web is pressed against a porous surface with a flow of hot air through the web at a velocity of from 250 to 800 ft./min. and at a temperature of from 140° to 250° C.

2. The process of claim 1 wherein the air in the bonding zone is at a temperature of from 215° to 250° C. whereby the binder filaments are melted without substantial melting of the matrix filaments.

3. The process of claim 1 wherein the web weight is from 0.3 to 6 oz./yd.$^2$.

4. The process of claim 1 wherein the steam consolidation and the hot air bonding is performed as a continuous operation.

* * * * *